United States Patent [19]

Foster

[11] Patent Number: 4,486,735

[45] Date of Patent: Dec. 4, 1984

[54] LATCH FOR A SNAP-ACTION SWITCH

[75] Inventor: Terence J. C. Foster, Buxton, England

[73] Assignee: Otter Controls Limited, Buxton, England

[21] Appl. No.: 401,734

[22] Filed: Jul. 26, 1982

Related U.S. Application Data

[63] Continuation-in-part of Ser. No. 193,447, Oct. 3, 1980, Pat. No. 4,341,932.

[30] Foreign Application Priority Data

Nov. 26, 1981 [GB] United Kingdom ..... 8135757

[51] Int. Cl.[3] ..... H01H 37/74

[52] U.S. Cl. ..... 337/348; 200/67 DA; 200/74; 200/325; 337/55; 337/367

[58] Field of Search ..... 200/67 DA, 70, 73, 74, 200/325, 72 R; 337/55, 343, 348, 365, 367

[56] References Cited

U.S. PATENT DOCUMENTS

| | | | |
|---|---|---|---|
| 304,557 | 9/1884 | Pirnie | 200/74 |
| 2,753,413 | 7/1956 | Anderson | 200/73 |
| 2,822,440 | 2/1958 | Karlsson | 200/74 |
| 2,896,041 | 7/1959 | Schwaneke | 200/73 |
| 3,213,244 | 10/1965 | McCarrick | 200/67 DA |
| 3,284,582 | 11/1966 | Hill et al. | 200/325 X |
| 4,039,991 | 8/1977 | Bucheister | 337/348 |
| 4,075,594 | 2/1978 | Tomoyoshi | 337/348 |

FOREIGN PATENT DOCUMENTS 1036127 12/1983 United Kingdom .

*Primary Examiner*—John W. Shepperd
*Assistant Examiner*—Renee S. Kidorf

[57] ABSTRACT

An electrical switch comprises a snap-acting actuator blade movable with a snap action between two configurations to control the making and breaking of electrical contacts and a latching mechanism which, when the actuator blade has snap-acted in one sense to break or make the contacts, prevents return movement of a movable contact carrying member until the latching mechanism has been positively released. The latching mechanism comprises a pivotal rigid member having an arm defining an engaging portion, for restraining return movement of the movable contact carrying member, and a biasing spring which urges the latching member in the movable contact carrying member engaging direction.

13 Claims, 10 Drawing Figures

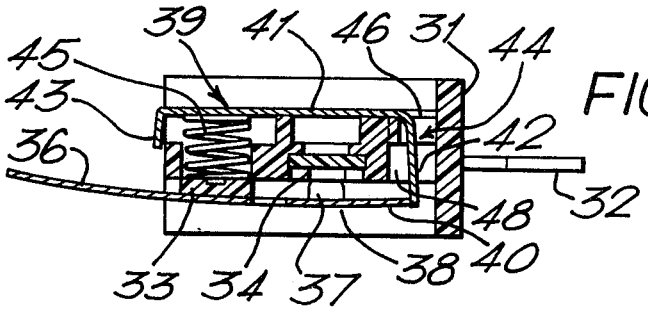
FIG.5.
FIG.6.
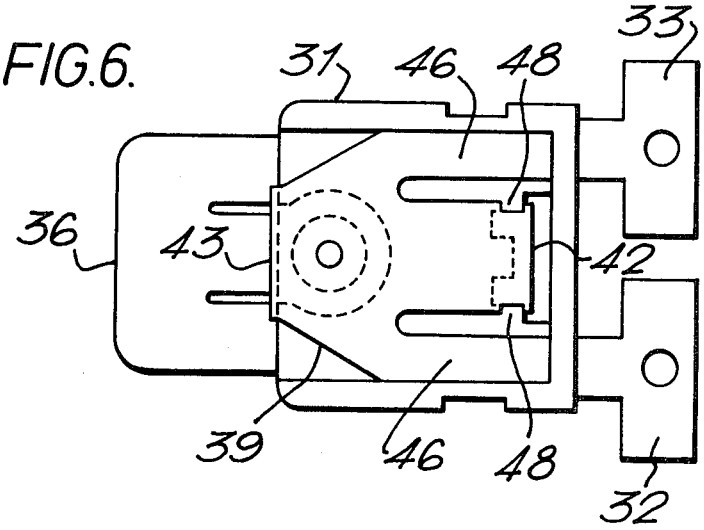
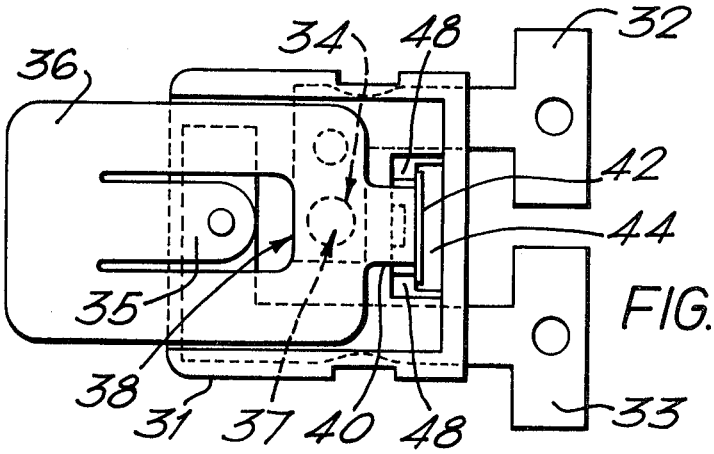
FIG.7.

LATCH FOR A SNAP-ACTION SWITCH

This application is a continuation-in-part of U.S. patent application Ser. No. 193,447 filed Oct. 3, 1980, now U.S. Pat. No. 4,341,932.

This invention relates to electric switches incorporating a snap-acting actuator comprising a stressed disc, sheet or strip of resilient sheet material (termed an actuator blade) movable with a snap-action between two configurations to control the making and breaking of the switch contacts, and a latching member which when the actuator blade has snap-acted in one sense to break or make the switch contacts restrains return movement of a movable contact carrying member to prevent re-making or re-breaking of the contacts i.e. the resetting of the switch until said latching member is positively displaced to permit return movement of the movable contact carrying member. Such switches will hereinafter be termed "switches of the kind described". The disc, sheet or strip of resilient material may be made of bimetallic material to provide a thermally-responsive switch or it may be made of suitable spring metal in which case the switch will be mechanically actuatable. The actuator blade itself may constitute the movable contact carrying member, or alternatively, the actuator blade may act upon a contact carrying or controlling strip of resilient sheet material to make or break the contacts.

Thermally-responsive switches of the kind described find widespread use in many areas of technology, particulary for protecting apparatus and appliances, such as electric motors or heaters, against overheating. The latching member prevents the occurrence of a cycling behaviour in that the switch must be reset before any further operation of the apparatus or appliance can take place. Without the presence of the latching member the actuator blade would simple snap back into its original configuration only to snap act yet again on further overheating and perform cycles indefinitely.

Switches of the kind described are disclosed in U.K. Patent Specification No. 1036127 wherein the latching member is in the form of a spring arm extending transversely with respect to the actuator blade and movable transversely to the plane of movement of the blade between its latching and unlatching positions. To displace the latching member and reset the switch requires a movement of the resetting member again transversely to the plane of movement of the actuator blade. If this resetting member were to be disposed close to the blade or contacts it would interfere with the operation of the actuator or the switch terminals, so it was disposed in a location spaced from the actuator. This however resulted in an undesirable increase in the overall size of the switch.

A further disadvantage of these known switches is that a substantial amount of movement of the actuator blade was required in order to release the latching member to spring into its latching position. This caused manufacturing difficulties since it was necessary to insure that actuator blades produced all possessed a sufficient amount of deflection to release the latching member.

It is an object of the invention to provide a switch of the kind described which does not have these disadvantages.

According to one exemplary embodiment of the invention there is provided a switch of the kind described wherein the latching member comprises a pivotally mounted rigid member having an arm extending generally transversely to the general plane of the actuator blade, said arm defining an engaging portion for restraining return movement of the movable contact carrying member, said rigid member also having a main body portion portion connected with said arm at an angle thereto and extending generally parallel to said actuator blade, said main body portion being pivotal and resiliently biased so that said engaging portion is normally urged toward the movable contact carrying member.

The engaging portion of the arm may engage the actuator blade or the contact carrying member where that member is separate from the actuator blade.

The movement of the operating portion necessary for resetting the switch is in the direction of movement of the movable contact carrying member rather than transversely thereto and the difficulties mentioned earlier do not arise. Furthermore the operating portion and the engaging portion are integrally combined in a single rigid member which is a substantial improvement in terms of manufacturing cost over previous switches where two or more components were provided to perform the same function.

In the present embodiment the rigid latching member is biased, at the end opposite from the arm which defines the contact carrying member engaging portion, by a spring mounted in the switch body. Unlatching may be accomplished by overcoming the bias of this separate spring whereby the latching member may pivot in the switch body to thereby move the engaging portion away from the movable contact carrying member.

In order that the invention may be readily understood three embodiments thereof will now be described by way of example with reference to the accompanying drawings in which:

FIG. 5 shows a center sectional view through a third switch embodying the present invention, FIG. 6 is a top plan view of the switch of FIG. 5, FIG. 7 is an underneath plan view of the switch of FIGS. 5 and 6, and FIGS. 8A, 8B and 8C show the latching member of the switch of FIGS. 5 to 7 in side elevation, end elevation and plan views respectively.

Figure 1:
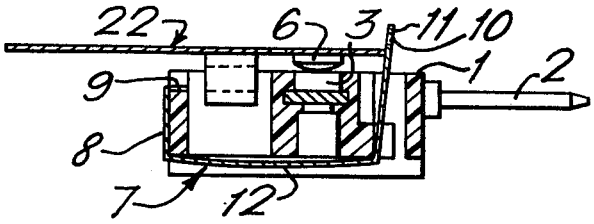
FIG. 1 shows a longitudinal section through a switch according to the invention.

In FIG. 1 there is shown a molded plastics switch body 1 having terminals 2, 14 extending therefrom. One terminal 2 is connected to a switch contact 3 and the other terminal 14 is connected to the tongue 4 of a movable contact carrying member in the form of a known snap acting bimetallic actuator blade 22 which is mounted by means of the said tongue to the switch body 1. The bridge portion 5 of the actuator blade carries a movable contact 6.

A latching spring member in the form of a U-shaped copper alloy spring strip 7 is sprung around and then engaged to the switch body 1. The left hand arm 8 is formed with a flange 9 which engages about a shoulder on the switch body and serves to retain the spring strip on the body. The right hand arm or actuator blade engaging portion 10 is formed with a bifurcated actuator blade engaging end 11, and is resiliently biased in an anti clockwise direction to engage the actuator blade. The bridge or operating portion 12 of the U-shaped spring member is slightly bowed and it will be seen that upward pressure on this operating part will cause arm 10 to pivot clockwise (FIG. 1) and the end 11 will withdraw from the blade.

Figure 2:
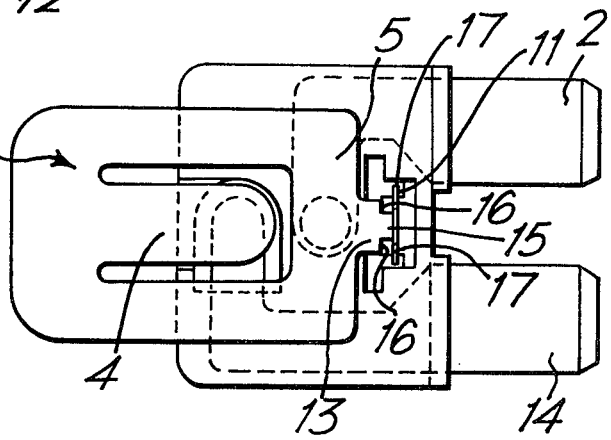
FIG. 2 is a plan view of the switch of FIG. 1.

From FIG. 2 will be seen the extension tab 13 on the blade against which the end of the arm 10 engages, the arm 10 therefore being well spaced from contacts 3, 6. The tab 13 includes a narrow end portion 15 having a shoulder 16 on each side thereof. In the latched position of the switch, the portion 15 enters the gap between ears 17 of the bifurcated portion 11, and the shoulders 16 bear against the ears 17, thus preventing further anti-clockwise movement of the arm 10.

On reaching a predetermined temperature the blade snaps through to open the contacts 3, 6 and this raising of the bridge portion 5 causes the arm 10 to deflect under its own resilience in an anti-clockwise direction and the portion 15 to engage the gap between the ears 17 and restrain the blade from snapping through to its original configuration on a drop in temperature.

To reset the blade, upward pressure is applied to bowed portion 12, causing the end 11 of arm 10 to move substantially parallel to the general plane of the blade and allow the latter to remake the contacts 3, 6. This pressure can be applied by a simple button, by rotation of a coarsely threaded member, or lateral movement of a wedge or otherwise.

In a modified embodiment, the bifurcated end 11 of the arm 10 comprises two ears which are bent out of the plane of arm 10 towards the main body of the blade, i.e. to the left as seen in FIG. 1. When the blade snap acts to open the contacts, excessive travel of the actuator blade is prevented by engagement with the ears.

Figure 3:
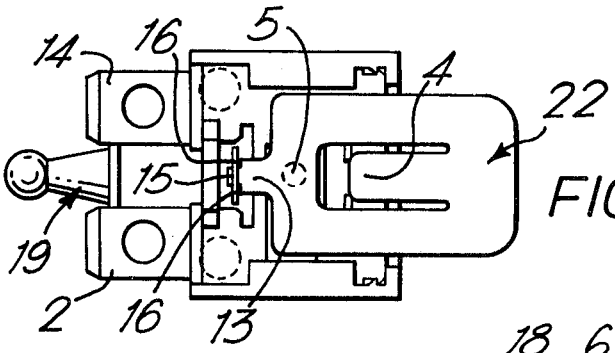
FIG. 3 is a plan view of a second embodiment of a switch according to the invention.
Figure 4:
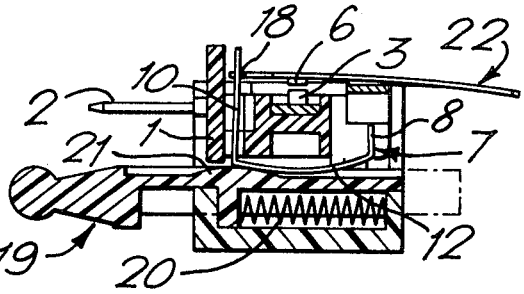
FIG. 4 is a section through the embodiment of FIG. 3.

The embodiment of FIGS. 3 and 4 is similar to that of FIGS. 1 and 2 and identical parts have been given the same reference numerals. The features common to the two embodiments will not be further described.

In place of the bifurcated end 11 of the arm 10, the spring strip 7 has a rectangular slot 18 therethrough which the portion 15 of the tab 13 enters in the latched position of the switch. Thus, when the bimetallic actuator moves to break the contacts 3, 6, the portion 15 enters the slot 18 and further movement of the actuator is prevented by engagement of the portion 15 with the edge of the slot 18 which is shown as being uppermost in FIG. 4. Excessive actuator movement resulting in fatigue of the actuator is thus prevented. This feature can be enhanced by deformation of the portion of the arm 10 above the slot 18 towards the main body of the blade. When the blade attempts to remake the contacts 3, 6, for example upon cooling, this is prevented by engagement of the portion 15 with the edge of the slot which is shown as being lowermost in FIG. 4.

In addition, the embodiment of FIGS. 3 and 4 shows a reset slide member 19. The slide member 19 is biased leftwardly as shown in the Figures by means of a coil spring 20. The member 19 includes a cam portion 21. When the slide member 19 is pushed rightwardly as shown in the Figures into the position indicated by broken lines in FIG. 4, against the force of the spring 20, the cam portion 21 exerts an upwardly directed force against the bowed portion 12 of the spring member 7, thus rotating the arm 10 of the spring member 7 in the anti-clockwise direction as shown in FIG. 4, thus allowing the actuator to make the contacts 3, 6. Once this has been done, and the member 19 is released, it returns to the illustrated position under the force of the spring 20.

Referring to FIGS. 5 to 7, there is shown therein a switch comprising a molded plastics switch body 31 having terminals 32 and 33 extending therefrom. One terminal 32 is connected to a fixed switch contact 34, and the other terminal 33 is fixedly connected to the tongue 35 of a movable contact carrying member in the form of a generally known snap-acting bimetallic actuator blade 36 which carries the movable contact 37 of the switch on its bridge portion 38. As will be appreciated the switch is thermally responsive both to ambient temperature conditions and to overload current flow through the switch to open its contacts.

Figure 8A:
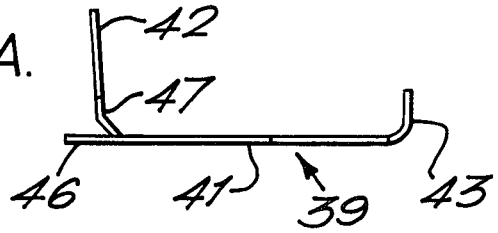
Figure 8B:
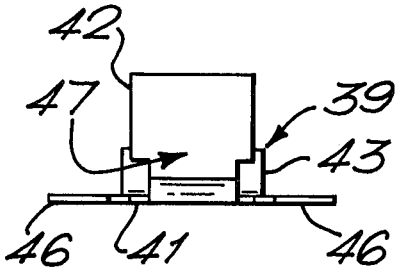
Figure 8C:
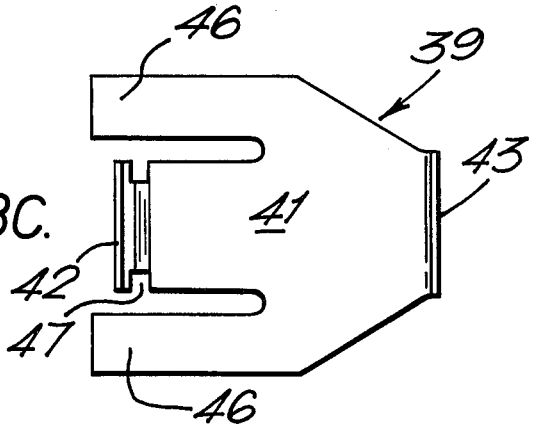

A latching member 39, shown in more detail in FIGS. 8A, 8B and 8C is arranged to cooperate with an extension tab 40 formed on the bridge portion 38 of actuator blade 36. The latching member 39 is formed of relatively rigid sheet material such as brass for example and has a main body (or operating) portion 41, an actuator blade engaging portion 42 upstanding (as viewed in FIG. 8A) from the operating portion 41 at one end thereof, and a tail portion 43 upstanding from the operating portion 41 at the other end thereof. As may be seen most clearly in FIG. 5, the latching member 39 mounts in the switch body 31 with the operating portion 41 extending generally parallel to the general plane of the actuator blade 36, with its portion 42 extending through an opening 44 formed in the switch body 31 into cooperation with the extension tab 40 formed on the actuator blade, and with its tail portion 43 hooked over the edge of the switch body. As will be described more particularly hereinafter, the latching member is able in effect to pivot upon the switch body 31 at the juncture of the operating portion 41 and the actuator blade engaging portion 42, and is urged by means of a coil spring 45 housed in a recess in the switch body 31 towards its most clockwise position when viewed as in FIG. 5.

When the switch contacts 34 and 37 are closed, as is the condition shown in FIG. 5, the extension tab 40 of the actuator blade abuts the portion 42 of the latching member and limits clockwise pivotal movement of the latching member 39, but should the temperature of the actuator blade 36 increase to the point where the blade snaps to its other condition thereby opening the switch contacts and dropping the extension tab 40 of the actuator blade downwardly (as viewed in FIG. 5), then the latching member 39 is enabled to pivot since the extension tab 40 no longer represents a limiting abutment, and moves to a position whereat the portion 42 abuts the upper surface (as viewed in FIG. 5) of the extension tab 40 and prevents the bimetallic blade 36 from resetting automatically when the temperature falls. Thus the switch contacts will remain latched open until such a time as the latching member is pivoted counter-clockwise against the action of spring 45, the impetus for this resetting of the latch member being manual or from any appropriate source.

The precise form of the latching member 39 is shown in FIGS. 8A, 8B and 8C. Attention is directed particularly to the pair of limbs 46 which are defined in the operating portion 41 of the latching member, and to the waisted section 47 defined at the juncture of the operating portion 41 and the actuator blade engaging portion 42. The limbs 46 bear at their free end extremities in respective corners formed in the moulded plastics body 31 (see FIG. 5) to provide a fulcrum for pivotal movement of the latching member 39, and the waisted section 47 engages loosely with formations 48 in the molded switch body 31 which extend into the opening 44 from opposite sides thereof so as to entrap the portion 42 of the latching member 39 within the opening 44. The engagement of the tail portion 43 of the latching member 39 with the rear end of the switch body completes the securement of the latching member 39 to the switch body 31 by limiting the extent of permissible displacement of the latching member 39 in a direction parallel with the plane of the operating portion 41 and towards the switch terminals 32 and 33 to an amount less than that which would be required to disengage the necked or waisted section 47 of the latching member from the formations 48 formed in the opening 44.

Various alterations and modifications could be made to the embodiment of FIG. 5 without departure from the spirit and scope of the invention. In particular, the modifications described in connection with the embodiments of FIGS. 1 to 4 are largely applicable to the situation of the FIG. 5 embodiment.

I claim:

1. A thermally-responsive electric switch comprising:

a switch body formed from an electrically insulating material;

first and second switch terminals mounted in said switch body;

a fixed switch contact mounted in said switch body and electrically connected to said first switch terminal;

a snap-acting actuator comprised of stressed bi-metallic material, said actuator including a blade which is movable with snap-action between two configurations for changing the state of the switch contacts, said blade having a portion which is fixed relative to said switch body, said fixed portion being electrically connected to said second switch terminal, said actuator further having a portion which is movable relative to said switch body in response to temperature induced changes in the configuration of said blade;

a movable switch contact carried by said actuator movable portion, said movable contact being positioned and configured to cooperate with said fixed switch contact whereby the configuration of said bi-metallic actuator blade will determine whether said switch contacts are in the open or closed state; and latching means which, when the bi-metallic actuator blade has snapped from a first to a second configuration, restrains return movement of said movable portion thereof to the first configuration to thereby prevent resetting of the switch until said latching means is positively released, said latching means comprising a one-piece latch member of substantially rigid material received in said switch body, said latch member having a major portion with oppositely disposed first and second ends, said major portion at least partly over-lying and being spaced from said bi-metallic blade, said latch member further having a minor portion extending from the first end of said major portion toward said actuator movable portion, said latching means also including pivotal support means for said latch member whereby said latch member is supported on said switch body in such a manner as to be capable of a limited degree of pivotal movement, said pivotal support means extending from said first end of said latch member major portion, said latching means further comprising separate spring means, said spring means biasing the second end of said latch member major portion in a direction generally away from said blade, the arrangement of said latch member major and minor portions being such that said minor portion is biased by the action of said spring means upon said major portion into abutting relationship with an edge of said actuator movable portion when said actuator blade has a first configuration and the switch is in a first state, the latch member pivoting under the action of said spring means so as to cause the minor portion thereof to move generally toward the position occupied by said blade in its first configuration so as to place the free end of said minor portion in a position where return movement of said movable portion is prevented by said latching member minor portion free end upon said blade snapping to its second configuration whereupon the switch will be latched in its second state, unlatching of the switch to permit the actuator movable portion to return the movable switch contact to the first state being accomplished by applying a force to said major portion of said latch member in the region of said second end thereof in a direction counter to said spring bias so as to effect a bodily pivotal movement of the latch member opposite to the latching movement thereof to thereby rotate said free end of the minor portion of the latch member out of the path of return movement of the actuator movable portion.

2. A thermally-responsive electric switch according to claim 1 wherein said latch member is formed of sheet metal material and has a main body section constituting said major portion, an actuator engaging arm constituting said minor portion, said arm upstanding from said first end of said main body section, and a tail section upstanding from the second end of said main body section, said pivotal support means being integral with said main body portion section and comprising a pair of limbs each attached at a first end to said main body section and having a free end, the free end of each limb bearing against an abuttment formed in the switch body to provide a fulcrum for said pivotal movement of said latch member, said arm extending through an opening formed in the switch body and engage loosely therein, and said tail section contacting said switch body.

3. A thermally-responsive electric switch according to claim 1 wherein the bimetallic actuator blade has a generally U-shaped cut-out defining a tongue which is free at one end and extends between two outer leg portions, and wherein said movable portion comprises a bridge portion interconnecting the ends of the leg portions adjacent the free end of the tongue, said movable switch contact being mounted on said bridge portion.

4. A thermally-responsive electric switch according to claim 3 wherein said actuator has an extension tab extending from said bridge portion for cooperation with said latch member.

5. A thermally-responsive electric switch according to claim 3 wherein the said portion of said blade which is fixed relative to the switch body is the free end of said tongue.

6. A thermally-responsive electric switch according to claim 5 wherein said actuator has an extension tab extending from said bridge portion for cooperation with said latch member.

7. A thermally-responsive electric switch according to claim 1 wherein the said switch contacts are normally in the closed state and said switch is latched in the open state by the action of said latching means.

8. The thermally-responsive electric switch according to claim 7 wherein said latch member is formed of sheet metal material and has a main body section constituting said major portion, an actuator engaging arm constituting said minor portion, said arm upstanding from said first end of said main body section, said pivotal support means being integral with said main body section and comprising a pair of limbs each of which extends from said main body section to a free end, the free end of each limb bearing against an abuttment formed in the switch body to provide a fulcrum for said pivotal movement of said latch member, said arm extending through said opening formed in the switch body and engaged loosely therein.

9. The thermally-responsive electric switch according to claim 8 wherein said latch member further comprises a tail section upstanding from the second end of said main body section, said tail section contacting said switch body.

10. A thermally-responsive electric switch according to claim 8 wherein the bimetallic actuator blade has a generally U-shaped cut-out defining a tongue which is free at one end and extends between two outer leg portions, and wherein said movable portion comprises a bridge portion interconnecting the ends of the leg portions adjacent the free end of the tongue, said movable switch contact being mounted on said bridge portion.

11. A thermally-responsive electric switch according to claim 10 wherein the said portion of said blade which is fixed relative to the switch body is the free end of said tongue.

12. A thermally-responsive electric switch according to claim 11 wherein said actuator has an extension tab extending from said bridge portion for cooperation with said latch member for latching the switch in the open state.

13. The thermally-responsive electric switch according to claim 12 wherein said latch member further comprises a tail section upstanding from the second end of said main body section, said tail section contacting said switch body.

* * * * *